US007028855B2

(12) United States Patent
Edwards

(10) Patent No.: US 7,028,855 B2
(45) Date of Patent: Apr. 18, 2006

(54) HANGER SPACER AND TRANSPORT ASSEMBLY UTILIZING SAME

(76) Inventor: Todd A. Edwards, 5050 Emerald St., Capitola, CA (US) 95062

( * ) Notice: Subject to any disclaimer, the term of this patent is extended or adjusted under 35 U.S.C. 154(b) by 38 days.

(21) Appl. No.: 09/916,725

(22) Filed: Jul. 26, 2001

(65) Prior Publication Data

US 2003/0019826 A1 Jan. 30, 2003

(51) Int. Cl.
*A47K 10/04* (2006.01)

(52) U.S. Cl. ..... 211/123; 211/85.3; 211/72; 211/183

(58) Field of Classification Search ..... 211/123, 211/85.31, 119, 124, 7, 113, 126.1, 85.3, 211/183, 72; 206/290, 291, 161; 223/85, 223/87

See application file for complete search history.

(56) References Cited

U.S. PATENT DOCUMENTS

| | | | | | |
|---|---|---|---|---|---|
| 1,793,035 | A | * | 2/1931 | Whitney | 211/123 |
| 2,162,168 | A | * | 6/1939 | Eboli | 206/284 |
| 2,604,999 | A | * | 7/1952 | Sutton | 211/113 |
| 2,658,627 | A | * | 11/1953 | Magnuson | 211/113 |
| 2,757,804 | A | * | 8/1956 | Sadwin | 104/108 |
| 2,827,160 | A | * | 3/1958 | Richer | 206/291 |
| 2,873,851 | A | * | 2/1959 | Abramson | 206/291 |
| 3,057,460 | A | * | 10/1962 | Richer | 206/289 |
| 3,057,482 | A | * | 10/1962 | Irving | 211/124 |
| 3,268,088 | A | * | 8/1966 | Lawhorn | 211/113 |
| 3,318,460 | A | * | 5/1967 | Becker | 211/123 |
| 3,373,878 | A | * | 3/1968 | Daitch | 211/119 |
| 3,480,153 | A | * | 11/1969 | Collin | 211/124 |
| 3,528,590 | A | * | 9/1970 | Nathanson | 223/85 |
| 3,543,668 | A | * | 12/1970 | Vlock | 396/651 |
| 3,613,898 | A | * | 10/1971 | Brennan | 211/124 |
| 3,631,898 | A | * | 1/1972 | Harley | 138/157 |
| 3,670,937 | A | * | 6/1972 | Bradshaw | 294/171 |
| 3,746,222 | A | * | 7/1973 | Tiss | 223/87 |
| 3,870,157 | A | * | 3/1975 | Hayward | 108/29 |
| 4,126,231 | A | * | 11/1978 | Derwent-Wryde | 211/99 |
| 4,318,518 | A | * | 3/1982 | Davis | 248/60 |
| 4,333,590 | A | * | 6/1982 | Princiotta | 223/85 |
| 4,496,060 | A | * | 1/1985 | Anderson et al. | 211/124 |
| 4,760,929 | A | | 8/1988 | Fedorchak | |
| 4,923,235 | A | * | 5/1990 | Stewart | 294/141 |
| 4,940,174 | A | * | 7/1990 | Parker | 224/257 |
| 4,944,436 | A | * | 7/1990 | Moen et al. | 223/87 |
| 4,971,210 | A | | 11/1990 | Blumenkranz et al. | |
| 5,018,694 | A | | 5/1991 | Olson | |
| 5,076,447 | A | * | 12/1991 | De Beer | 211/123 |

(Continued)

FOREIGN PATENT DOCUMENTS

| | | | | |
|---|---|---|---|---|
| CA | 971512 | * | 7/1975 | 211/123 X |

(Continued)

*Primary Examiner*—Jennifer E. Novosad
(74) *Attorney, Agent, or Firm*—Dorsey & Whitney LLP

(57) ABSTRACT

An apparatus for receiving and separating a plurality of hangers having respective necks. The apparatus comprises a body of a substantially rigid material extending along a longitudinal axis. The body has opposite first and second surfaces and a plurality of longitudinally spaced-apart openings. The openings extend between the opposite first and second surfaces and are adapted for respectively receiving the necks of the plurality of hangers. The spacing of the hangers by the body inhibits wrinkling of garments or other objects carried by the hangers. The body has first and second longitudinally-extending portions inclined at an angle relative to each other. The inclination of the first and second portions relative to each other provides rigidity to the body.

25 Claims, 4 Drawing Sheets

U.S. PATENT DOCUMENTS

| | | | | | |
|---|---|---|---|---|---|
| D329,982 | S | | 10/1992 | Young | |
| 5,160,048 | A | * | 11/1992 | Leyden et al. | 211/7 |
| 5,572,775 | A | | 11/1996 | Mailloux et al. | |
| 5,601,016 | A | * | 2/1997 | Witte | 108/106 |
| D393,371 | S | | 4/1998 | Dunn | |
| 5,899,041 | A | * | 5/1999 | Durin | 211/126.1 |
| 6,196,399 | B1 | * | 3/2001 | Pacheco | 211/113 |
| 6,568,545 | B1 | * | 5/2003 | Feder | 211/124 |
| 2002/0148797 | A1 | * | 10/2002 | Feder | 211/124 |
| 2003/0192846 | A1 | * | 10/2003 | White | 211/123 |

FOREIGN PATENT DOCUMENTS

| | | | | |
|---|---|---|---|---|
| JP | 175688 | * | 10/1998 | 211/123 X |

* cited by examiner

HANGER SPACER AND TRANSPORT ASSEMBLY UTILIZING SAME

FIELD OF THE INVENTION

This invention relates generally to garment hanging accessories, and more particularly to devices for spacing garment hangers.

BACKGROUND OF THE INVENTION

Hanger spacer devices have been provided that space garments along the length of a garment-supporting rod. In such devices, the hanger spacers are typically mounted on the rod and are thus not usable in transporting garments, such as by professional dry cleaning or laundering businesses.

Another prior device is a hanger clip, which provides for grouping of garment hangers. The hanger clip, however, does not space the garments apart, and thus does not inhibit wrinkling of the garments. Another prior hanger separator provides for only one garment hanger and must be made with several portions of material. Yet another prior garment hanger bar is specifically for travel boxes and is thus limited in use.

OBJECTS AND SUMMARY OF THE INVENTION

In general, it is an object of the present invention to provide an apparatus for receiving and separating a plurality of hangers for garments or other objects.

Another object of the invention is to provide an apparatus of the above character that can be used for transporting such garments or other objects.

Another object of the invention is to provide an apparatus of the above character that inhibits wrinkling of the garments or other objects.

Another object of the invention is to provide an apparatus of the above character that is sturdy.

Another object of the invention is to provide an apparatus of the above character that is inexpensively and easily produced.

Another object of the invention is to provide an apparatus of the above character that is lightweight and is preferably integrally made from a single piece of material.

Another object of the invention is to provide an apparatus of the above character that is easily transported and is preferably easily stackable for shipping and distribution purposes.

Another object of the invention is to provide an apparatus of the above character that can be segmented.

These and other objects are achieved by an apparatus for receiving and separating a plurality of hangers having respective necks. The apparatus comprises a body of a substantally rigid material extending along a longitudinal axis. The body has opposite first and second surfaces and is provided with a plurality of longitudinally spaced-apart holes. The holes extend between the opposite first and second surfaces and are adapted for respectively recieveing the necks of the plurality of hangers. The spacing of the hangers by the body inhibits wrinkling of garments or other objects carried by the hangers. The body is provided with first and second longitudinally-extending portions inclined at an angle relative to each other. The inclination of the first and second portions relative to each other provides rigidity to the body.

Additional objects and features of the invention will appear from the following description from which the preferred embodiments are set forth in detail in conjunction with the accompanying drawings.

DETAILED DESCRIPTION OF THE INVENTION

Reference will now be made in detail to the preferred embodiments of the invention which are illustrated in the accompanying figures. The description of the embodiments of the invention will be followed by a discussion of their operation.

Figure 1:
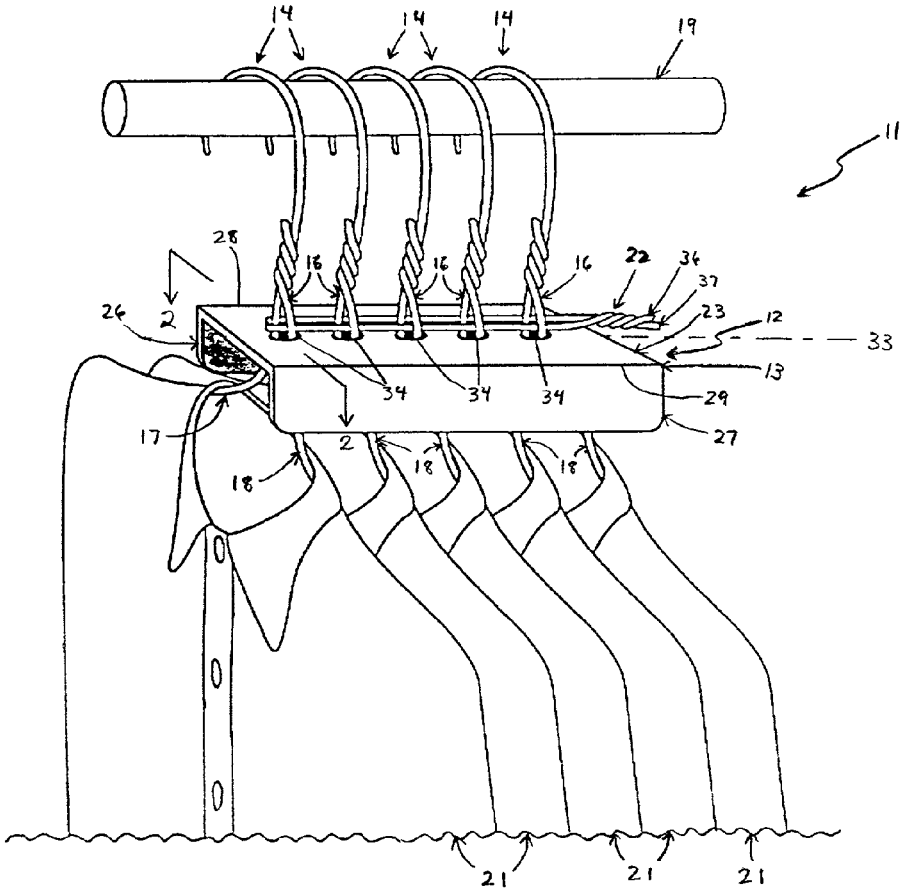
FIG. 1 is a perspective view of a transport assembly utilizing the hanger spacer of the present invention.
Figure 2:
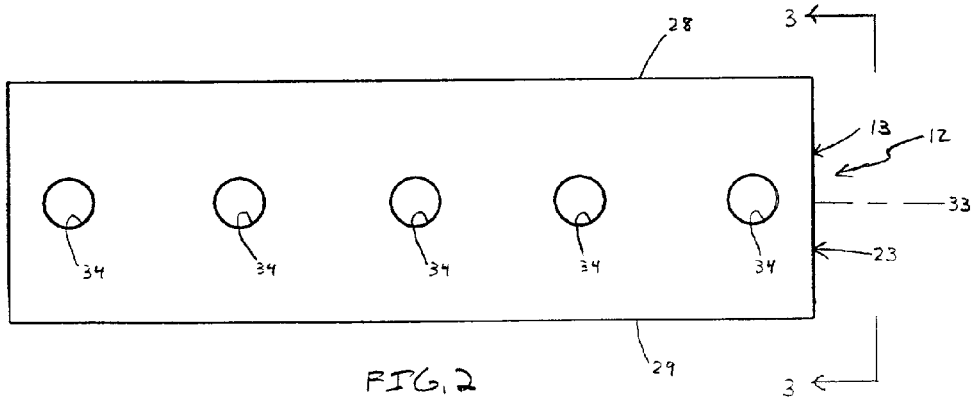
FIG. 2 is a top plan view of the hanger spacer of FIG. 1 taken along the line 2—2 of FIG. 1.

A transport assembly 11 of the present invention, shown in FIG. 1, has a hanger spacer or garment hanger spacer 12 formed from a body 13. Spacer 12 is for use in receiving and separating a plurality of hangers 14 having respective necks 16, as well as first and second arms 17 and 18. FIG. 1 shows a garment-supporting rod 19, on which and suitable object such as garments 21 are typically hung. FIG. 1 also shows an optional tie 22 of the present invention. The tie 22 may made of flexible wire or other material.

Figure 3:
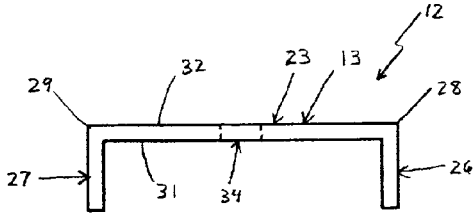
FIG. 3 is an end elevational view of the hanger spacer of FIG. 1 taken along the line 3—3 of FIG. 2.

Body 13 is preferably made from a suitable biodegradable material such as cardboard, but may also be made of any other substantially rigid material such as plastic. The body 13, as shown in FIGS. 1, 2, 3, and 4, has a central portion 23 and opposite first and second side portions 26 and 27. Portions 23, 26 and 27 are preferably substantially planar. The central portion 23 may have opposite first and second side edges 28 and 29, and first and second side portions 26 and 27 are joined to the central portion 23 at respective first and second edges 28 and 29. The body 13 has opposite first and second surfaces 31 and 32, as shown in FIG. 3. The central portion 23 of the body 13 also has a longitudinal axis 33 and is provided with a plurality of longitudinally spaced-apart openings or holes 34 extending between the opposite first and second surfaces 31 and 32. The first and second side edges 28 and 29 preferably extend parallel to the longitudinal axis 33.

The optional first and second side portions 26 and 27 may be inclined at respective angles relative to the central portion 23 and may be bendable relative to the central portion 23. The body 13 may have creases 28 and 29 in its material along the first and second side edges 28 and 29 for facilitating bending of the side portions 26 and 27 relative to the central portion 23. The length of the central portion 23 and first and second side portions 26 and 27 ranges from one to ten inches and preferably ranges from one to six inches. The width of the central portion 23 ranges from three-quarters inch to two inches and preferably ranges from three-quarters inch to one inch, and the width of the first and second side portions 26 and 27 ranges from one-quarter inch to two inches and preferably ranges from one-quarter inch to one half inches. There may be any number of longitudinally spaced-apart holes 34 in spacer 12. The spacing between holes 34 ranges from one-eighth inch to six inches and preferably ranges from one-quarter inch to one inch. In the preferred embodiment, the first and second side portions 26 and 27 are each inclined at an angle of approximately 90 degrees relative .to the first surface 31 of the central portion 23. The first and second side portions 26 and 27 may each be inclined, however, at any less angle than 180 degrees relative to the first surface 31 of the central portion 23.

Figure 4:
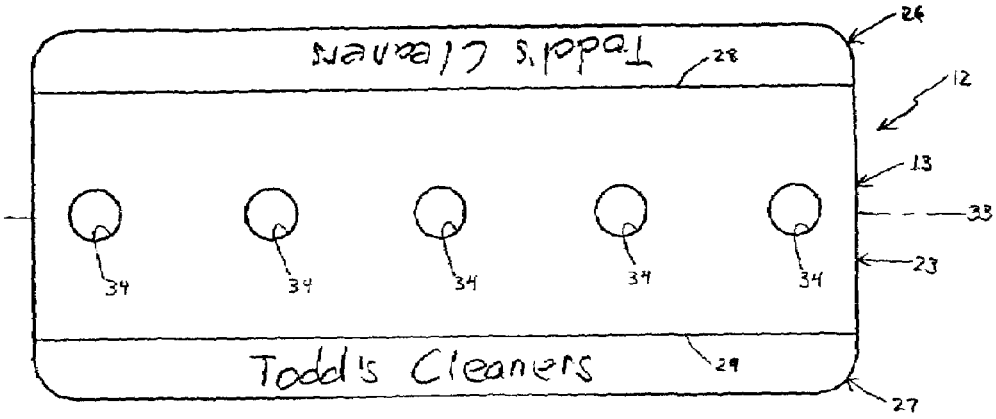
FIG. 4 is a top plan view of the hanger spacer of FIG. 1 in an unfolded position.

In operation and use, garment hanger spacer 12 is particularly useful for storing and transporting clothing and other cleaned objects, such as drapes or similar cloth objects, that can be carried by hangers 14 or similar devices. Holes 34 therein are adapted for respectively 16 of a plurality of garment hangers 14, as shown in FIG. 1. The inclination of the first and second side portions 26 and 27 relative to the first surface 31 of the central portion 23 inhibits bending of the hanger spacer 12 and thus provides rigidity to the hanger spacer 12. Garment transport assembly 11 is thereby relatively sturdy and, with or without the use of optional tie 22, is particularly suited for holding together a plurality or garments or objects during transport. For example, a cleaner can grasp one or two of the garments 21 carried by spacer 12 and the remainder of the garments carried by the spacer will follow along. If no tie 22 is used, the hangers 14 carrying the remainder of the garments will not separate from the spacer but, at worst, will drop relative to the spacer 12 until the hooks thereof catch on the spacer 12. The outer surface or either or both of side portions 26 and 27 is particularly suited for advertising, as shown in FIG. 4 where the words "Todd's Cleaners" are printed thereon.

Body 13 may be produced in a variety of sizes having differing numbers of holes. The spacing of holes 34 may vary. When the holes are spaced apart a sufficient distance, central portion 23 inhibits wrinkling of garments 21 carried by the first and second arms 17 and 18 of the garment hangers 14. Regardless of the spacing of holes 34, spacer 12 can serve to group together, for transport or otherwise, a plurality of hangers 14 and the objects carried thereby The optional tie 22 may extend through the necks 16 of the garment hangers 14 above the body 13 and has first and second ends 36 and 37 that can be tied together. The tie 22 further precludes the garment hangers 14 from undesirably separating from the body 13, and can thus serve to lock together an order of clothing during transport or storage by a cleaner. Tie 22 further ensures that all of the hangers 14 carried by spacer 12 remain at the same height.

Figure 5:
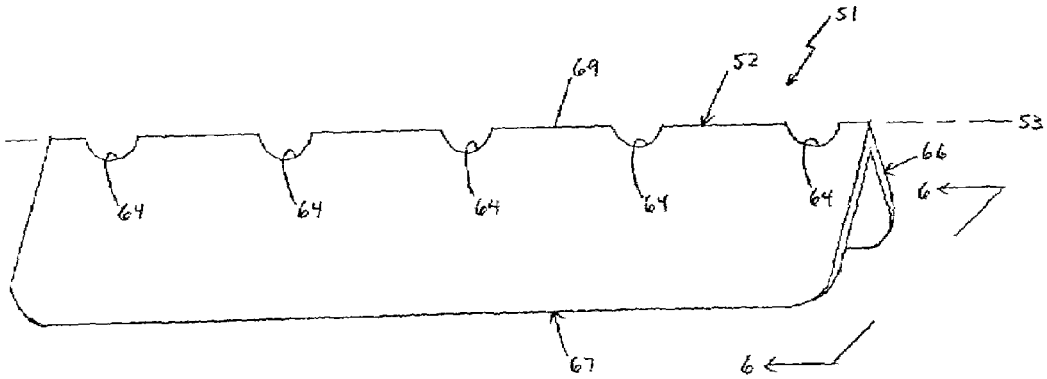
FIG. 5 is a perspective view of another embodiment of the hanger spacer of the present invention.
Figure 6:
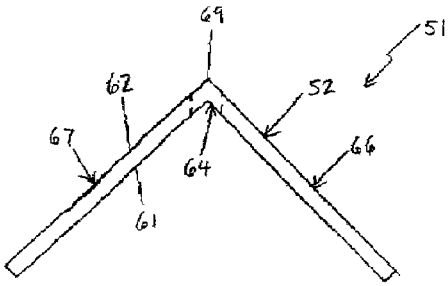
FIG. 6 is an end elevational view of the hanger spacer of FIG. 5 taken along the line 6—6.

The hanger spacer of the present invention can have a variety of shapes and sizes, and preferably has at least first and second elongate portions which are inclined relative to each other for providing rigidity to the spacer. In another embodiment of the present invention, a garment hanger spacer 51 comprises a body 52 (see FIGS. 5 and 6). Garment hanger spacer 51 is also for use in receiving and separating a plurality of hangers. Body 52 may be made of cardboard but may also be made of any other substantially rigid material. The body 52 extends along a longitudinal axis 53 and has opposite first and second surfaces 61 and 62, as shown in FIG. 6. The body 52 is provided with a plurality of longitudinally spaced-apart holes 64 extending between the opposite first and second surfaces 61 and 62. The body 52 also has substantially planar first and second portions 66 and 67, which extend parallel to the longitudinal axis 53. The first and second portions 66 and 67 may meet at an edge 69 and each extend downwardly from the edge 69 towards the hangers. The longitudinal axis 53 is preferably a longitudinal centerline, such that the edge 69 extends along the longitudinal centerline, and the holes 64 are preferably spaced along the longitudinal centerline.

First and second portions 66 and 67 are inclined relative to each other and are preferably bendable toward each other. The body 52 may have a crease 69 in the material along the edge 69 facilitating the bending of the first and second portions 66 and 67 relative to each other. The first and second portions 66 and 67 can have lengths similar to the lengths discussed above for central portion 23 and side portions 26 and 27 of spacer 12. The width of the first and second portions 66 and 67 can range from one-quarter inch to three inches and preferably ranges from three-quarters inch to one and one-half inches. There may be any number of longitudinally spaced-apart holes 64, and the spacing between holes 64 can be similar to the spacing discussed above with respect to holes 34 of hanger spacer 12. The first and second portions 66 and 67 are each inclined at an angle of approximately 90 degrees relative to each other, however may be inclined at any angle less than 180 degrees relative to each other.

In operation and use, the holes 64 are adapted for respectively receiving the necks of the plurality of hangers. The inclination of the first and second portions 66 and 67 relative to each other provides rigidity to the body 52. Further, the spacing of the hangers by the spaced-apart holes 64 inhibits wrinkling of garments or other objects carried by the hangers. Because the hanger spacers 51 of FIGS. 5 and 6 have only one crease, the spacers may be easily stacked one on top of the other, particularly if each spacer has first and second portions 66 and 67 that are inclined at the same angle relative to each other. Any number of spacers may be stacked one on top of the other. The spacers may be bent at any angle to fit most economically into the bag, box or other container in which the spacers are shipped. Thus, the hanger spacers or garment hanger spacers 51 of FIGS. 5 and 6 are particularly suited for stacking to facilitate shipping and distribution thereof.

Figure 7:
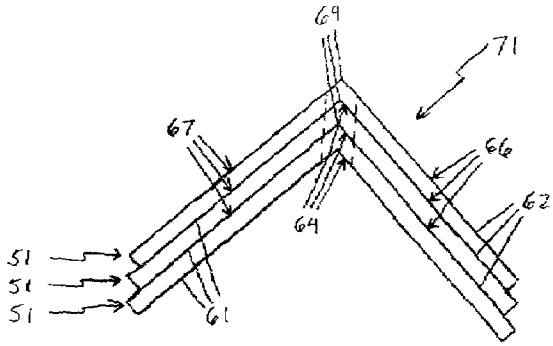
FIG. 7 is an end elevational view of a plurality of the hanger spacers of FIG. 6 stacked for shipping and distribution purposes.

A plurality or stack 71 of garment hangers 51 is shown in FIG. 7. In this regard, a hanger spacer 51 is stacked on top of another hanger spacer 51, which is stacked on top of yet another hanger spacer 51. As discussed above, each hanger spacer 51 has first and second surfaces 61 and 62, first and second portions 66 and 67 joined to each other at an edge 69, as well as spaced-apart holes 64 extending between the first and second surfaces 61 and 62.

Figure 8:
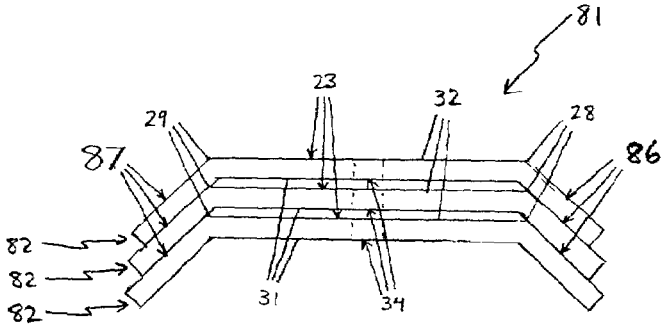
FIG. 8 is an end elevational view, similar to FIG. 7, of yet another embodiment of the hanger spacer of the present invention stacked with similar hanger spacers for shipping and distribution purposes.

Yet another embodiment of a plurality of stackable hanger spacers of the present invention is shown in FIG. 8. In stack 81 shown therein, a plurality of hanger spacers or garment hanger spacers 82 are disposed one on top of another for shipping and distribution purposes. For example, hanger spacer 82 is stacked on top of another hanger spacer 82, which is stacked on top of yet another hanger spacer 82. Each hanger spacer 82 has some like components of the hanger spacer 12 of FIG. 3 and like reference numerals have been used to describe such like components. Each hanger spacer 82 has a central portion 23 having opposite first and second side edges 28 and 29 as well as first and second surfaces 31 and 32. Each hanger spacer 82 also has spaced-apart holes 34 extending between the first and second surfaces 31 and 32. First and second side portions 86 and 87, substantially similar to side portions 26 and 27 of spacer 12, are joined to the central portion 23 of each spacer 82 at respective first and second edges 28 and 29. The first and second side portions 86 and 87 are each inclined relative to the central portion 23 and are preferably bendable relative to the central portion 23. More specifically, first and second side portions 86 and 87 of each hanger spacer 82 are inclined relative to first surface 31 of the central portion 23 at any angle less than 180 degrees and preferably at an angle of greater than 90 degrees. Alternatively, the first side portion 86 may be inclined relative to the first surface 31, while the second side portion 87 may be inclined relative to the second surface 32, both surfaces being inclined at an angle of 180 degrees or less and preferably at an angle of greater than 90 degrees. These alternate versions of inclined first and second side portions 86 and 87 facilitate the stacking of the plurality of hanger spacers 82 for shipping and distribution purposes.

Figure 9:
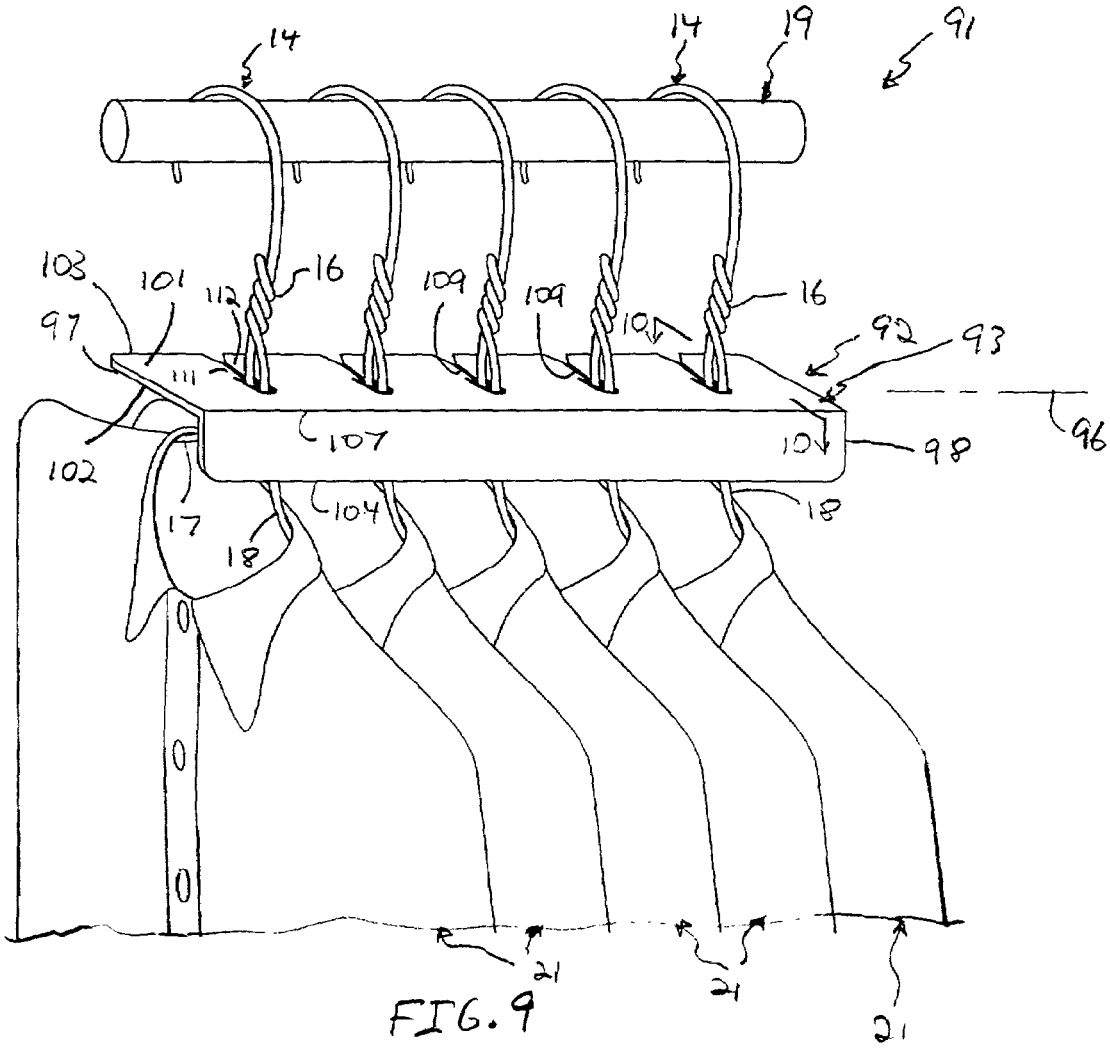
FIG. 9 is a perspective view of another embodiment of a transport assembly utilizing the hanger spacer of the present invention.

Another transport assembly utilizing an apparatus for spacing hangers of the present invention is shown in FIG. 9. Transport assembly 91 therein has similarities to transport assembly 11 and like reference numerals have been used to described like components of transport assemblies 11 and 91. Transport assembly 91 has a hanger spacer or garment hanger spacer 92 formed from a body 93 for use in receiving and separating a plurality of hangers 14. The elongate body 93 is made from any suitable materials such as plastic and extends along a longitudinal axis 96. The body 93, as shown in FIGS. 9 and 10, has a central portion 97 and at least one side portion 98, each of which portions are preferably substantially planar, and opposite first and second surfaces 101 and 102 and first and second edges 103 and 104 adjoining the first and second surfaces 101 and 102.

Central and side portions 97 and 98 of body 93 are inclined relative to each other. In this regard, the central portion 97 has an elongate side edge 106 extending substantially parallel to first edge 103 and the side portion 98 is joined to central potion 97 at the side edge 106. Although the central and side portion 97 and 98 can be rigidly or permanently inclined relative to each other, such portions are preferably bendable relative to each other so that body 93 can be substantially planar, as shown in FIG. 10, or the portions 97 and 98 can be moved relative to each other so as to be inclined at a right or other angle relative to each other, as shown in FIG. 9. When portions 97 and 98 are bendable relative to each other, a crease 107 is optionally formed in body 93 along side edge 106 for facilitating such bending. Such crease 107 extends substantially parallel to longitudinal axis 96.

Body 93 of garment hanger spacer 92 is provided with a plurality of longitudinally spaced-apart openings 109 extending between first and second surfaces 101 and 102 in central portion 97. Although openings 109 can be of any suitable type, the openings of garment hanger spacer 92 are preferably each elongate slits 109 formed with a central portion 109*a* having a cross-sectional area at least as large as the cross-sectional area of hanger neck 16 and a narrowed portion 109*b* extending from the central portion 109*a* to an opening 109*c* in first edge 103. The central portion 109*a* of each slit 109 is preferably, substantially centered on central portion 97 and the central portions 109*a* are preferably spaced apart along the length of the central portion 97 at equal spacings. The elongate slits 109 are preferably substantially perpendicular to longitudinal axis 96 and, as such, are substantially parallel to each other. The central portion 97 is formed with first and second flaps 111 and 112 for forming the narrowed portion 109*b* of each slit 109. Flaps 111 and 112 are spaced apart a distance, equal to the width of narrowed portion 109*b*, which is substantially less than the transverse dimension of central portion 109*a* that is aligned with longitudinal axis 96. The flaps 111 and 112 flare outwardly at opening 109*c*. Each of the first and second flaps 111 and 112 has an inner end 116 which extends into central portion 109*a*.

Figure 10:
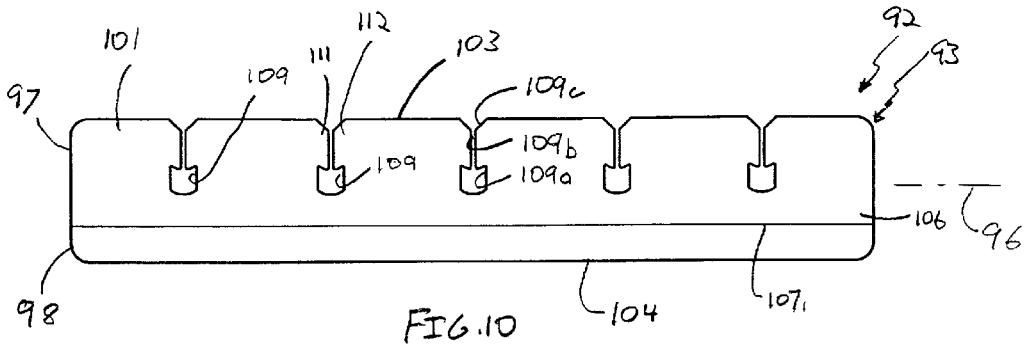
FIG. 10 is a top plan view of the hanger spacer of FIG. 9 taken along the line 10—10 of FIG. 9.

Garment hanger spacer 92 can have any suitable length and width and, as shown, has a length of approximately 5.5 inches and a width between first and second edges 103 and 104 when planar as shown in FIG. 10 of approximately one inch. As discussed above, the spacing between slits 109 can vary depending upon the desired spacing between garments 21. Slits 109 are shown as being spaced apart a distance of approximately one inch. The inclination of side portion 98 to central portion 97 can be any angle between zero and 180 degrees, including a right angle, an acute angle or an obtuse angle. Crease 107 is spaced between slits central portion 109*a* and first edge 103.

In operation and use, garment hanger spacer 92 is used in the manner discussed above to receive a plurality of hangers 14 so as to inhibit wrinkling of the garments 21 carried by spacer 92 during transport and storage. Once a garment 21 has been placed on its hanger 14, the hanger neck 16 is pushed through opening 109*c* and then narrowed portion 109*b* so as to be disposed within central portion 190*a* of respective slit 109. The flared ends of first and second flaps 111 and 112 facilitate insertion of the hanger neck 16 into the slit 109. Flaps 111 and 112 are bendable so as to permit the narrowed portion 109*b* to expand in width to accommodate the passage of hanger neck 16. Once the hanger neck 16 is disposed within central portion 109*a*, first and second flaps 111 and 112 inhibit undesired movement of the hanger neck 16 from central portion 109*a*. In this regard, the inner end 116 of each of the first and second flaps 111 and 112, which extends into central portion 109*a*, inhibits the bending of the flaps 111 and 112 and thus passage of the hanger neck 16 out of central portion 109*a* and slit 109.

Optional tie 22, not shown in FIG. 9, can be used for securing together hanger neck 16 and thus further inhibiting separation of hangers 14 from garment hanger spacer 92. The inclination of side portion 98 relative to central portion 97 inhibits undesirable bending of the central portion 97 out of its plane. Garment hanger spacers 92 can be easily stacked in the manner discussed above and as shown in FIG. 7.

Figure 11:
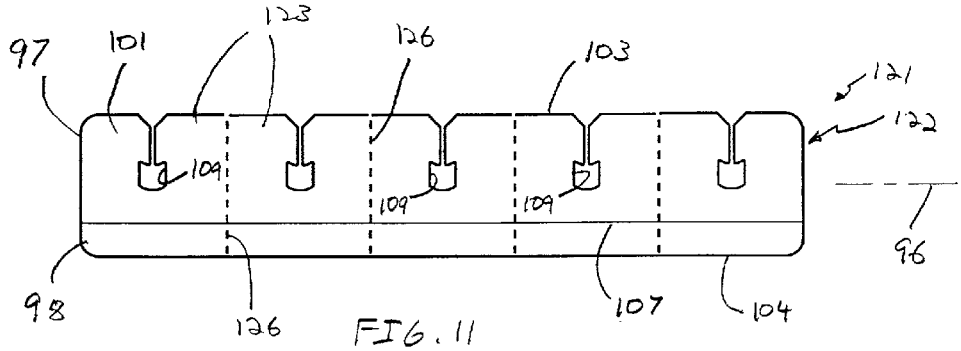
FIG. 11 is a top plan view, similar to FIG. 10, of a further embodiment of the hanger spacer of the present invention.

Other apparatus for spacing hangers having similarities to the foregoing described garment hanger spacers can be provided. Hanger spacer or garment hanger spacer 121, shown in FIG. 11, has similarities to garment hanger spacer 92 and like reference numerals have been used to describe like parts of garment hanger spacers 92 and 121. The garment hanger spacer 121 is formed from a body 122 that is substantially similar to body 93 and provided with central and side portions 97 and 98. The body 122 is longitudinally dividable into a plurality of segments 123 by means of a plurality of longitudinally spaced-apart weakened areas. For example, a plurality of longitudinally spaced-apart perforated lines 126 can serve as such weakened areas. Each of the lines 126 extends transversely of longitudinal axis 96 and is disposed between an adjacent pair of slits 109. The lines 126 are preferably centered between the adjacent pair of slits 109 so that segments 123 each have an equal length.

In operation and use, garment hanger spacer 121 can be used in the manner described above. Perforated lines 126 permit the garment hanger spacer to be easily shortened. For example, body 122 can be first bent along a perforated line 126 and then torn along the line so as to separate one or more segments 123 from the remainder of body 122. One or both of such segmented portions of the body 122 can then be used in a manner discussed above.

Figure 12:
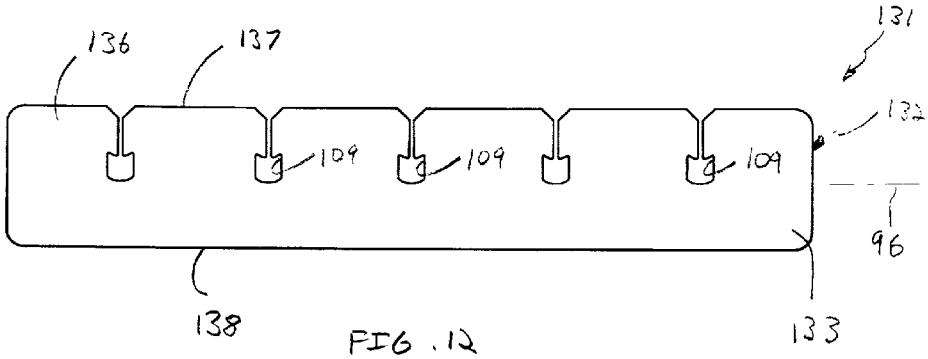
FIG. 12 is a top plan view, similar to FIG. 10, of yet another embodiment of the hanger spacer of the present invention.

In a further embodiment of the apparatus for spacing hangers of the present invention, a garment spacer or garment hanger spacer 131, shown in FIG. 12, is provided that is substantially similar to garment hanger spacer 92. Like reference numerals have been used herein and in FIG. 12 to describe like parts of garment hanger spacers 92 and 131. A body 132 substantially similar to body 93 is provided. The body 132 is made from any suitable material such as cardboard, but is preferably made from plastic, and has a central portion 133 provided with first and second surfaces 136, substantially similar to first and second surfaces 101 and 102, and first and second edges 137 adjoining the surfaces 136. Body 132 is different from body 93 in that the body 132 includes no side portion, such as side portion 98, inclined relative to the central portion 133. A plurality of longitudinally spaced-apart slits 109 are included in body 132. Each of the slits 109 opens at its respective opening 109*c* onto first edge 137.

The operation and use of garment hanger spacer 131 is substantially similar to that of garment hanger spacer 92 described above. The plastic material of body 132 can provide sufficient rigidity to garment hanger spacer 131 in certain applications. It should be appreciated that spacer 131 can be provided with weakened areas, such as perforated lines 126, for segmenting the spacer and be within the scope of the present invention.

It should be appreciated that hanger spacers described herein can have a variety of conformations. For example, any number of two or greater elongate portions inclined relative to each other. In this regard, a hanger spacer may have three edges, such as the edge 69 of FIG. 6, as well as the two edges 28 and 29 of FIG. 3. In another example, the hanger spacer can be similar to hanger spacer 82, but provided with one or more additional side portions depending at an inclination from each side portion 86 and 87. Such additional side portions, not shown, can extend parallel or otherwise with respect to each other.

The width of the hanger spacers hereof can be made so that the side portions of the hanger spacer drape over the collars of any shirts or blouses carried by the hangers. In this manner, undesirable grasping of such collars can be inhibited and thus wrinkling of the collars minimized.

The elongate portions of the spacers of the present invention need not be inclined downwardly towards the hangers 14 and garments 21. Instead, one or more of the elongate portions may be inclined upwardly away from the hangers and garments. For example, any of the spacers described herein can be inverted so that the elongate portions extend upwardly and away from the hangers 14 and garments 21.

In addition to the foregoing, the various elongate portions of the spacers of the present invention do not necessarily need to be substantially planar. For example, the portions of the spacers may be made of a curved, yet still substantially rigid, material.

The holes or openings of the spacers do not necessarily need to be equally spaced apart as shown in FIGS. 1, 2, 4, and 5. For example, some pairs of openings may be spaced further apart from each other than other pairs of openings, in order to accommodate garments or objects of thicker material. Further, and as discussed above, the openings can be spaced relatively close together when one of the main objectives of the spacer is merely to hold together a plurality of hangers 14 and the objects carried thereby.

From the foregoing, it can be seen that a hanger spacer for receiving and separating a plurality of hangers for garments or other objects has been provided. The spacer is particularly suited for transporting such garments or other objects, and the spacing of the garments or other objects by the hanger spacer inhibits wrinkling of the garments or objects. The first and second side portions provide rigidity to the hanger spacer, thus making the transport assembly sturdy. The spacers of the present invention are relatively inexpensive because of the simplicity of the design and the inexpensive materials. The garment or hanger spacer is easily produced because it is preferably made from one piece of material and has a simple design. The spacer is lightweight because it can be made of cardboard, plastic or any other bendable material. Because the hanger spacer is a distinct item, it provides for ease in the transportation of garments or objects, such as by professional dry cleaning and laundering businesses. The inclination of the at least first and second elongate portions relative to each other provides for ease of stacking a plurality of the hanger spacers for shipping and distribution purposes. Perforations or other weakened areas can be provided in the hanger spacer for facilitating segmentation of the spacer.

What is claimed is:

1. A lightweight hanger spacer for use with a plurality of hangers having respective necks comprising a unitary body of a single layer of material selected from the group consisting of cardboard and plastic extending along a longitudinal axis, the body having opposite first and second surfaces and being free of folds, the body being provided with a plurality of longitudinally spaced-apart circumferentially-closed holes extending through the single layer of material between the opposite first and second surfaces adapted for receiving the respective necks of the plurality of hangers whereby the circumferentially-closed holes retain the necks of the plurality of hangers within the holes during transport and the spacing of the hangers by the body inhibits wrinkling of garments carried by the hangers.

2. The hanger spacer of claim 1 wherein the body is made from cardboard.

3. The hanger spacer of claim 1 wherein the body is made from plastic.

4. The hanger spacer of claim 1 wherein the body is provided with a single set of a plurality of longitudinally spaced-apart holes extending through the single layer of material between the opposite first and second surfaces.

5. The hanger spacer of claim 1 wherein the body has first and second longitudinally-extending portions inclined at an angle relative to each other whereby the inclination of the first and second portions relative to each other provides rigidity to the body.

6. The hanger spacer of claim 5 wherein the first and second portions are bendable relative to each other.

7. The hanger spacer of claim 5 wherein the body has a crease in the cardboard between the first and second portions for facilitating bending of the first and second portions relative to each other.

8. The hanger spacer of claim 5 wherein the first and second portions meet at an edge and each extend downwardly from the edge towards the hangers.

9. The hanger spacer of claim 8 wherein the longitudinal axis is a longitudinal centerline and wherein the edge extends along the longitudinal centerline and the holes are spaced along the longitudinal centerline.

10. A lightweight hanger spacer for use with a plurality of hangers having respective hooks and adjoining necks comprising a unitary body of a single layer of nonmetallic material, the body being free of folds and having a substantially planar central portion and opposite first and second side portions inclined at respective angles relative to the central portion, the central portion having opposite first and second surfaces and a longitudinal axis, the central portion being provided with a plurality of longitudinally spaced-apart circumferentially-closed holes extending through the single layer of material between the opposite first and second surfaces adapted for threadedly receiving the respective hooks and adjoining necks of the plurality of hangers whereby the circumferentially-closed holes retain the necks of the plurality of hangers within the holes and the first and second side portions provide rigidity to the body during transport and the spacing of the hangers by the central portion inhibits wrinkling of garments carried by the hangers.

11. The hanger spacer of claim 10 wherein the body is made from cardboard.

12. The hanger spacer of claim 10 wherein the body has a crease between the central portion and each of the first and second side portions for facilitating bending of the side portions relative to the central portion.

13. The hanger spacer of claim 10 wherein the central portion has opposite first and second side edges, the first and second side portions being joined to the central portion at respective first and second side edges.

14. The hanger spacer of claim 13 wherein the opposite first and second side edges extend parallel to the longitudinal axis.

15. The hanger spacer of claim 10 wherein the first and second side portions are each inclined at an angle less than 180° relative to the first surface of the central portion.

16. The hanger spacer of claim 15 wherein the first and second side portions are each inclined at an angle of approximately 90° relative to the first surface of the central portion.

17. The hanger spacer of claim 10 wherein the central portion is provided with a single set of a plurality of longitudinally spaced-apart holes extending through the single layer of material between the opposite first and second surfaces.

18. An assembly comprising a plurality of hangers having respective necks, a plurality of garments respectively carried by the plurality of hangers, a unitary spacer extending along a longitudinal axis, the spacer having opposite first and second surfaces and being provided with a plurality of longitudinally spaced-apart circumferentially-closed holes extending between the opposite first and second surfaces for receiving the respective necks of the plurality of hangers, the spacer resting on at least some of the garments and hangers so as to be carried by at least some of the garments and hangers whereby the circumferentially-closed holes retain the necks of the plurality of hangers within the holes during transport and the spacing of the hangers by the spacer inhibits wrinkling of the garments.

19. The assembly of claim 18 wherein the spacer is provided with first and second longitudinally-extending portions inclined at an angle relative to each other for providing rigidity to the spacer.

20. The assembly of claim 19 wherein the first and second portions meet at an edge and each extend downwardly from the edge towards the hangers.

21. The assembly of claim 18 wherein the spacer is made from cardboard.

22. The assembly of claim 18 further comprising a tie extending through the necks above the spacer and having first and second ends that can be tied together whereby the tie precludes the hangers from undesirably separating from the spacer.

23. The assembly of claim 19 wherein the tie includes a flexible wire.

24. The assembly of claim 18 wherein the spacer is formed from a single layer of material and is provided with a plurality of longitudinally spaced-apart holes extending through the single layer of material between the opposite first and second surfaces.

25. The assembly of claim 24 wherein the spacer is provided with a single set of a plurality of longitudinally spaced-apart holes extending through the single layer of material between the opposite first and second surfaces.

* * * * *